US005293804A

United States Patent [19]

Myers

[11] Patent Number: 5,293,804

[45] Date of Patent: Mar. 15, 1994

[54] MULTIPLE RESONANT MODE STRINGED MUSICAL APPARATUS AND METHOD UTILIZING PRIMARY AND SECONDARY BODIES

[76] Inventor: Curtis P. Myers, 253 Lakeside Beach, Spicewood, Tex. 78669

[21] Appl. No.: 965,730

[22] Filed: Oct. 23, 1992

[51] Int. Cl.[5] ..... G10D 3/00

[52] U.S. Cl. ..... 84/291; 84/743

[58] Field of Search ..... 84/742, 743, 290, 291, 84/293, 314 R, 263, 267

[56] References Cited

U.S. PATENT DOCUMENTS

| | | | |
|---|---|---|---|
| 1,183,369 | 5/1916 | Gardie | 84/291 X |
| 3,780,612 | 12/1973 | Robinson | 84/173 |
| 4,079,652 | 3/1978 | Gittler | 84/743 |
| 4,240,319 | 12/1980 | Soupios | 84/263 |
| 4,343,217 | 8/1982 | Brody | 84/743 |
| 4,616,550 | 10/1986 | Lacroix et al. | 84/173 |
| 4,785,705 | 11/1988 | Patterson | 84/726 |
| 4,953,434 | 9/1990 | Guss | 84/263 |
| 4,987,815 | 1/1991 | Shockley | 84/291 |

*Primary Examiner*—William M. Shoop, Jr.
*Assistant Examiner*—Jeffrey W. Donels
*Attorney, Agent, or Firm*—Shaffer & Culbertson

[57] ABSTRACT

A double ended musical mechanism having a primary body for anchoring strings and containing electrical connections for electrical operation including pickups, volume, and tone controls, a secondary body for securing and tuning the strings and containing electrical connections, and an interconnecting central body. The central body, between the primary and secondary bodies, contains a number of hammer pads for temporarily anchoring strings against so that when a string is anchored against a hammer pad, two musical notes are produced, one each from the primary and secondary bodies.

An additional embodiment includes the provision of an electrical pickup in the central body so that when a string is anchored in two places against a hammer pad, three musical notes are produced. Yet another embodiment includes the provision of a primary neck with a device for anchoring the strings which contains a number of hammer pads, a secondary neck for securing and tuning the strings and containing a number of hammer pads, and an interconnecting central body, located between the primary and secondary necks, which contains electrical devices for operation so that when the strings are anchored against the hammer pads, two musical notes are produced.

10 Claims, 2 Drawing Sheets

MULTIPLE RESONANT MODE STRINGED MUSICAL APPARATUS AND METHOD UTILIZING PRIMARY AND SECONDARY BODIES

BACKGROUND OF THE INVENTION

This invention relates to an improved musical device for providing on one string more than a single musical note at a time. In particular, this invention relates to a double ended musical apparatus and method.

Musical instruments have been known since the dawn of time. Guitars, in particular, have been an integral part of the world's societies for ages. From classical guitar to rock and roll, guitars have flourished. A typical guitar is a flat-bodied string instrument that has a long fretted neck and usually six strings. It is played with a pick or plucked with the fingers and sounds an octave lower than written. In addition to the long fretted neck, the guitar shape is comprised of a strongly rounded lower portion separated from a comparable but often smaller upper portion by a smooth and gradual intermediate constriction.

Variations on the normal guitar include electric guitars. An electric guitar is a guitar whose tone is magnified electrically by a microphone or pickup device that is built into the instrument or attached externally, by an audio-frequency amplifier, and by a loud speaker. The volume and resonance, or tone, of the device is subject to control by the player.

Most guitars are hung or supported by the shoulder and held in front of the player while the player stands or sits upright. A variation of this usual manner in playing the guitar is represented by a so-called hawaiian guitar. This type of guitar is a flat-bodied stringed musical device that has a long fretted neck and usually six to eight strings. This guitar is held in a horizontal position either on the knees of the player or on an adjustable stand. It is played by plucking the strings with thimbles, the desired pitch being obtained by sliding a small metal bar across the raised strings.

There are still other variations of guitars, some guitars having more than one neck, for example, but displaced in the same relative position as "normal" prior art guitars.

A drawback to the non-electric and electric guitars known in the art is that only a single note is obtained from any of the prior art guitars whenever the guitar string is anchored against the fret. Thus, it would be an advancement in the musical art, pleasurable and, indeed, there is a need in the art, for providing a musical instrument in the nature of a guitar that produces more than one musical note at a time. It, therefore, is an object of this invention to provide an apparatus and method for a musical device that produces more than a single note at a time on a single string.

SHORT STATEMENT OF THE INVENTION

Accordingly, the double ended musical device of the present invention includes a primary body for anchoring strings and containing electrical connections including, pickups, volume, and tone controls. A secondary body is also provided for securing and tuning the strings which also contains electrical controls. Interconnecting the primary and secondary bodies is a central body which contains hammer pads for temporarily anchoring the strings against so that when a string is anchored against a hammer pad, two musical notes are produced, one each from the primary and secondary bodies.

Another embodiment of the invention includes placing an electrical pickup in the central body so that when a single string is anchored in two places against a hammer pad, three musical notes are produced.

In the preferred embodiment, the primary body includes an anchor for securing at least six strings, a saddle bridge, at least one tone selector, at least one volume selector, at least one electrical pickup, and at least one electrical input jack. The secondary body includes at least six zither pins for securing and tuning the strings, a saddle bridge, and at least one electrical pickup. The central body includes a central hammer pad with at least eighteen hammer pads to either side and each hammer pad is located at corresponding harmonic intervals.

Another embodiment of the invention includes a primary neck for anchoring strings and which contains a number of hammer pads, a secondary neck for securing and tuning the strings and containing a number of hammer pads, and an interconnecting central body, located between the primary and secondary necks, which contains electrical devices for operation so that when the strings are anchored against the hammer pads, two musical notes are produced. In this embodiment, the interconnecting central body includes at least two saddle bridges, at least two electrical pickups, at least one tone selector, at least one volume selector, and at least one electrical input jack. The primary neck includes a saddle bridge and an anchoring device for anchoring at least six strings and the secondary neck includes a saddle bridge and at least six zither pins for securing and tuning the strings. Additionally, the primary and secondary necks have at least eighteen hammer pads on each and each hammer pad is located at a corresponding harmonic interval.

BRIEF DESCRIPTION OF THE DRAWINGS

Other objects, advantages, and features of the present invention will become more fully apparent from the following detailed description of the preferred embodiment, the appended claims, and the accompanying drawings in which:

DETAILED DESCRIPTION OF THE PREFERRED EMBODIMENT

Figure 1:
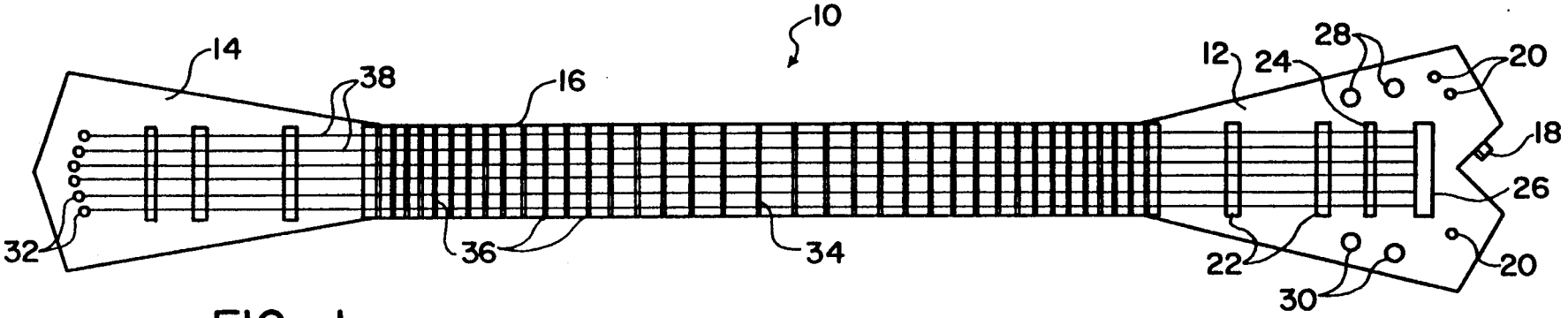
FIG. 1 is a top view of a preferred embodiment of the double ended musical device of the present invention.

The preferred embodiment of the present invention is illustrated by way of example in FIGS. 1–4. With specific reference to FIGS. 1 and 2, a double ended musical device 10 includes a primary body 12, a secondary body 14, and an interconnecting central body 16.

Primary body 12 includes electrical input jack 18, three pickup selector switches 20, two electrical pickups 22, a saddle bridge 24, a string anchoring device 26, two volume control knobs 28, and two tone control knobs 30.

Secondary body 14 includes electrical pickups 22, saddle bridge 24, and zither pins 32.

Interconnecting central body 16 includes a central hammer pad 34, and eighteen hammer pads 36 to either side of central hammer pad 34 spaced at harmonic intervals. Stretched across hammer pads 34 and 36 are six strings 38 secured at one end by a string anchoring device 26 on the primary body 12 and at the other end by zither pins 32, which are also used for tuning the strings 38.

Figure 2:
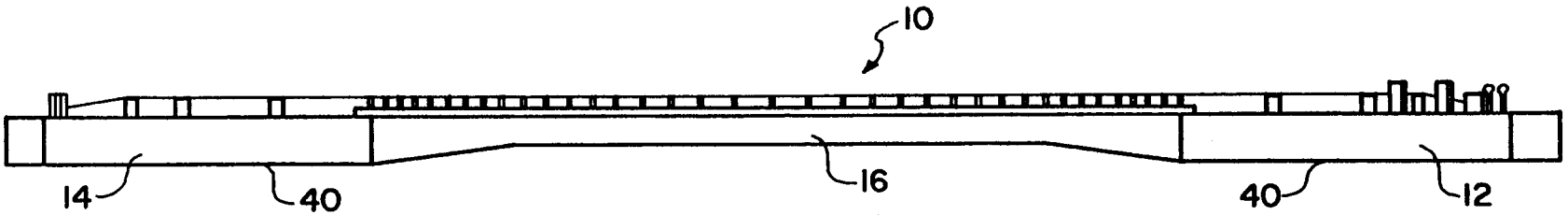
FIG. 2 is a side view of the invention of FIG. 1.

Referring now specifically to FIG. 2, it can be seen that interconnecting central body 16 is raised or bowed in relation to primary body 12 and secondary body 14. The bottom 40 of primary body 12 and secondary body 14 is designed to contact the surface when the device is placed in the bottom down position on a flat surface.

Figure 3:
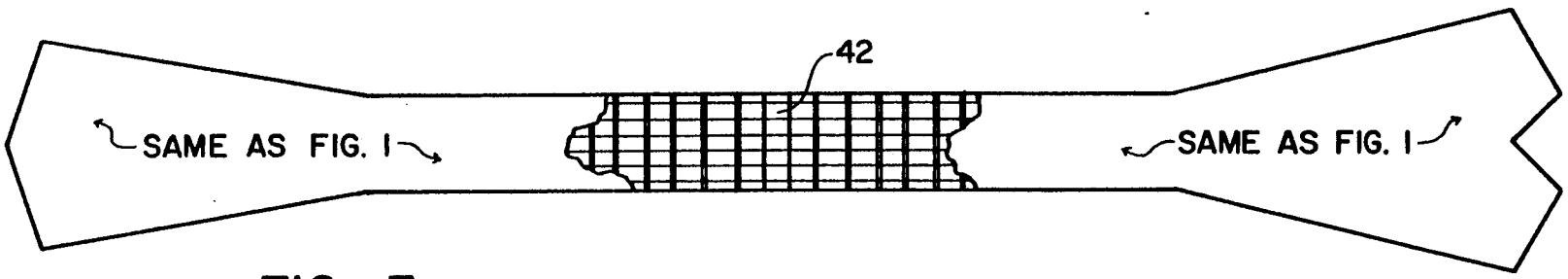
FIG. 3 is a top view of an alternative embodiment of the invention.

Referring now to FIG. 3, an alternative embodiment of the present invention is disclosed wherein interconnecting central body 16 also includes a centrally located electrical pickup 42. The remainder of the device as disclosed in FIGS. 1 and 2 is the same.

Figure 4:
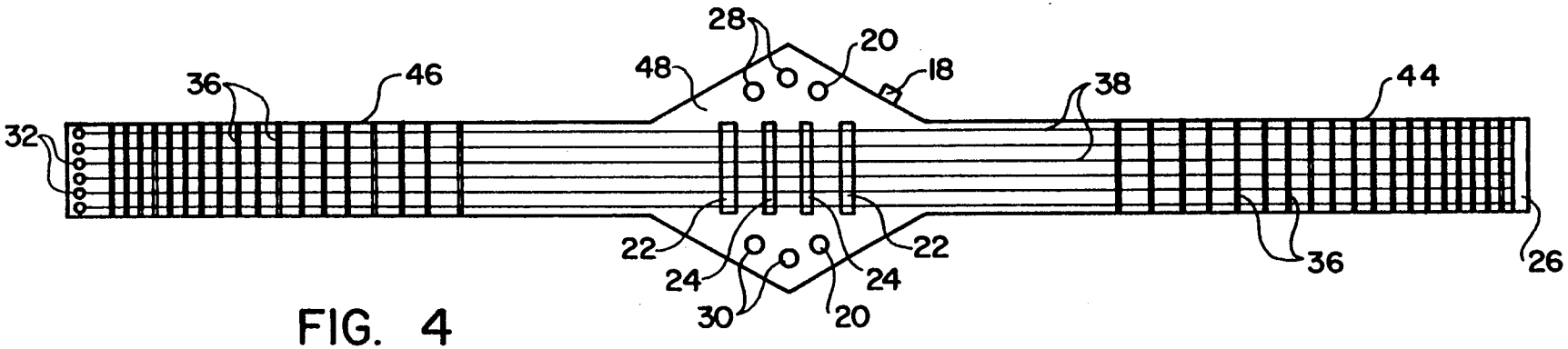
FIG. 4 is a top view of a third embodiment of the present invention.

Referring now to FIG. 4, an additional embodiment of the present invention is illustrated which includes a primary neck 44, a secondary neck 46, and a central body 48. Primary neck 44 includes a string anchoring device 26 and eighteen hammer pads 36. Secondary neck 46 includes zither pins 32 and eighteen hammer pads 36. While the number and arrangement may vary, central body 48 includes electrical input jack 18, pickup selectors switches 20, electrical pickups 22, and saddle bridges 24. Additionally, central body 48 includes volume control knobs 28 and tone control knobs 30. As in the previously described embodiments, this embodiment includes six strings 38 stretched between primary neck 44 and secondary neck 46.

Referring now to FIGS. 1 and 2, the operation of the device includes the steps of assembling the parts as detailed above in the manner illustrated. Once assembled, strings 38 are tuned by zither pins 32 in a manner known in the art. Once tuned, by means of picks, hammers, or hammer tips attached to artist's fingers, the strings 38 are pressed against hammer pads 36 in a manner known in the art. When this occurs, two notes are sounded in the embodiment illustrated in FIGS. 1 and 2, one from the primary body 12 and one from the secondary body 14. The number and manner of the electrical devices used to amplify and modify the sound produced is left to the discretion of the artist. The pickups are adjustable and, in fact, the number of strings, length of the interconnecting central body, width and shape, can be changed or customized as desired. The central result, however, is that two notes are obtained on each individual string when played.

Referring now to FIG. 3, an alternative embodiment of the present invention is disclosed wherein an additional centrally located electrical pickup 42 is installed in interconnecting central body 16. When this is accomplished, it is possible to obtain three musical notes from a single string, one from the primary body, one from the secondary body, and one at the centrally located electrical pickup 42 by anchoring a single string in two places.

FIG. 4 illustrates yet another embodiment of the invention wherein the controls and the pickups of the device are located in the central body 48. The primary neck 44 and the secondary neck 46 serve to separate the playing surfaces yet result in the same musical advancement in the provision of two notes on any one string as it is played.

While the present invention has been disclosed in connection with the preferred embodiment thereof, it should be understood that there may be other embodiments which fall within the spirit and scope of the invention as defined by the following claims.

I claim:

1. A double ended musical apparatus comprising:

(a) a primary body means for anchoring strings and containing electrical means for electrical operation including pickups, volume, and tone controls;

(b) a secondary body means for securing and tuning said strings and containing electrical means; and (c) an interconnecting central body means between said primary and secondary body means for containing a plurality of hammer pad means for temporarily anchoring said strings against so that when a string is anchored against a hammer pad, two musical notes are produced, one each from said primary and secondary body means.

2. The apparatus of claim 1 further comprising an electrical pickup in said central body means so that when a single string is anchored in two places against a hammer pad, three musical notes are produced.

3. The apparatus of claim 1 wherein said primary body means further comprises:

(a) a means for anchoring at least six strings;

(b) a saddle bridge;

(c) at least one tone selector;

(d) at least one volume selector;

(e) at least one electrical pickup; and (f) at least one electrical input jack.

4. The apparatus of claim 3 wherein said secondary body means further comprises:

(a) at least six zither pins for securing and tuning said strings;

(b) a saddle bridge; and (c) at least one electrical pickup.

5. The apparatus of claim 4 wherein said central body means further comprise:

(a) a central hammer pad with at least eighteen hammer pads to either side; and (b) each hammer pad located at corresponding harmonic intervals.

6. A method of providing two musical notes at the same time from a single string of a musical device comprising the steps of:

(a) providing a primary body means for anchoring strings and containing electrical means for electrical operation, including pickups, volume, and tone controls;

(b) providing a secondary body means for securing and tuning said strings and containing electrical means; and (c) interconnecting a central body means between said primary and secondary body means for containing a plurality of hammer pad means for temporarily anchoring said strings against so that when a string is anchored against a hammer pad two musical notes are produced, one each from said primary and secondary body means.

7. The method of claim 6 further comprising the step of providing an electrical pickup in said central body means so that when a single string is anchored in two places against a hammer pad, three musical notes are produced.

8. The method of claim 6 wherein providing said primary body means further comprises the steps of:

(a) providing an anchoring means for at least six strings;

(b) attaching a saddle bridge;

(c) attaching at least one tone selector;

(d) attaching at least one volume selector;

(e) attaching at least one electrical pickup; and (f) attaching at least one electrical input jack to said primary body means.

9. The method of claim 8 providing said secondary body means further comprises the steps of:

(a) providing at least six zither pins for securing and tuning said strings;

(b) providing a saddle bridge; and (c) providing at 1 one electrical pickup.

10. The method of claim 9 wherein the step of providing a central body means further comprises the steps of:

(a) providing a central hammer pad with at least eighteen hammer pads to either side; and (b) locating each hammer pad at corresponding harmonic intervals.

* * * * *